US006254403B1

(12) United States Patent
Bernardini

(10) Patent No.: US 6,254,403 B1
(45) Date of Patent: Jul. 3, 2001

(54) ASSEMBLY FOR AND METHOD OF SELECTIVELY GROUNDING CONTACTS OF A CONNECTOR TO A REAR PORTION OF THE CONNECTOR

(75) Inventor: Allen J. Bernardini, Southbury, CT (US)

(73) Assignee: Litton Systems, Inc., Watertown, CT (US)

( * ) Notice: Subject to any disclaimer, the term of this patent is extended or adjusted under 35 U.S.C. 154(b) by 0 days.

(21) Appl. No.: 09/362,958

(22) Filed: Jul. 30, 1999

(51) Int. Cl.[7] ..... H01R 4/66; H01R 13/648

(52) U.S. Cl. ..... 439/95

(58) Field of Search ..... 439/95, 108, 608, 439/620, 96, 97

(56) References Cited

U.S. PATENT DOCUMENTS

| | | |
|---|---|---|
| 3,739,076 | 6/1973 | Schwartz . |
| 3,753,204 | 8/1973 | Thompson et al. . |
| 3,790,858 | 2/1974 | Brancaleone et al. . |
| 4,120,552 | 10/1978 | Winkler et al. . |
| 4,695,105 | 9/1987 | Ney et al. . |
| 4,790,765 | 12/1988 | Ehrenfels et al. . |
| 4,820,174 | 4/1989 | Farrar et al. . |
| 4,887,971 | 12/1989 | Reuss et al. . |
| 4,986,761 | 1/1991 | Gladden, Jr. et al. . |
| 5,011,416 | 4/1991 | Gladden, Jr. et al. . |
| 5,151,033 | 9/1992 | Kawai et al. . |
| 5,169,323 | 12/1992 | Kawai et al. . |
| 5,174,768 | 12/1992 | Hewison et al. . |
| 5,199,891 | 4/1993 | Reed . |
| 5,240,424 | 8/1993 | Honma et al. . |
| 5,290,191 | 3/1994 | Foreman et al. . |
| 5,371,819 | 12/1994 | Szegda . |
| 5,415,568 | 5/1995 | Kinoshita . |
| 5,423,695 | 6/1995 | Robinson et al. . |
| 5,573,411 | 11/1996 | Bartosz et al. . |
| 5,691,505 | 11/1997 | Norris . |

*Primary Examiner*—Gary Paumen
*Assistant Examiner*—James Harvey
(74) *Attorney, Agent, or Firm*—Lowe Hauptman; Gilman & Berner

(57) ABSTRACT

An assembly for selectively grounding one or more contacts of a connector includes an elongate ground insert having a resilient outer periphery for fixing and electrically connecting the ground insert to an inner wall of a rear portion of the connector, the ground insert including an inner wall forming a perimeter around and spaced from all of the back portions of the contacts of the connector, while the ground insert is fixed to and within the rear portion. The assembly includes an elongate grounding leg fastenable to an upper rim of the ground insert, the grounding leg including first and second spaced ends for respectively engaging the ground insert and a back portion of a selected contact to be grounded, to thereby electrically connect the selected contact to the rear portion through the grounding leg and the ground insert.

21 Claims, 5 Drawing Sheets

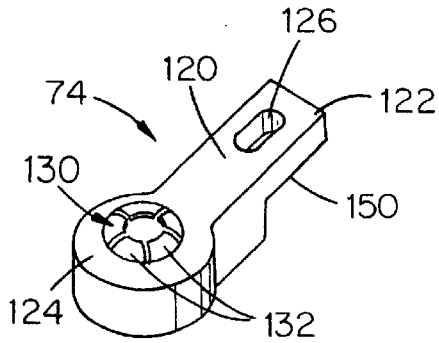
FIG. 4A
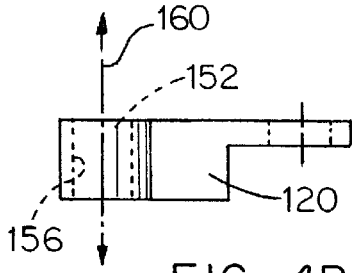
FIG. 4B
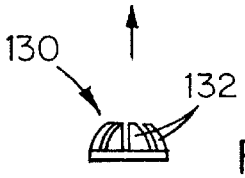
FIG. 4C
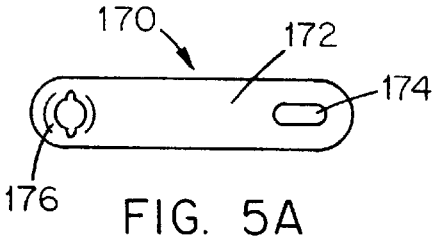
FIG. 5A
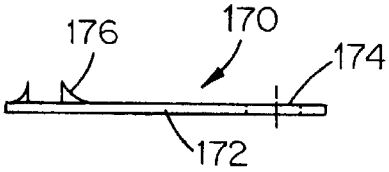
FIG. 5B
FIG. 6A
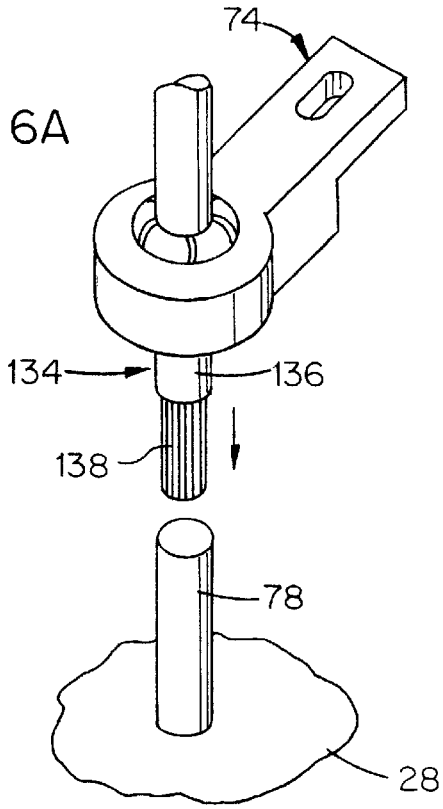
FIG. 6B
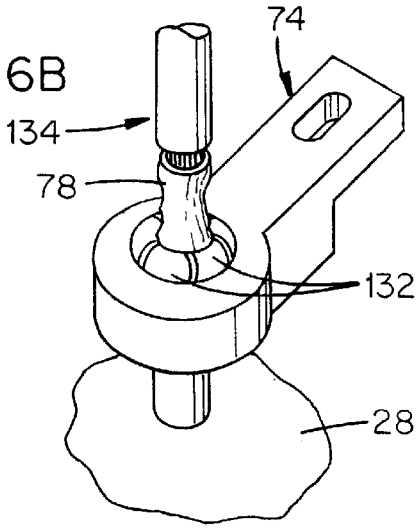

ASSEMBLY FOR AND METHOD OF SELECTIVELY GROUNDING CONTACTS OF A CONNECTOR TO A REAR PORTION OF THE CONNECTOR

FIELD OF THE INVENTION

The present invention relates generally to electrical grounding devices, and more particularly, to such a device for selectively grounding one or more electrical contacts of an electrical connector.

BACKGROUND OF THE INVENTION

There often arises a need to electrically connect one or more electrical contacts of an electrical connector to a ground potential, and more specifically, to connect the one or more electrical contacts to a grounding site near or within the electrical connector. This need can arise during connector assembly or after connector assembly. After connector assembly, the need to ground one or more contacts can arise before connecting any electrical wires to the connector contacts, or after connecting wires to the connector contacts, as for example, in a fielded connector system.

One attempt to meet the described need is described in U.S. Pat. 5,290,191. The '191 patent discloses a device for grounding a contact in a commonly known, standardized type of electrical connector. The electrical connector includes a housing or connector shell and an insulating support fixed to and within the connector shell. A plurality of electrical contacts arranged in a predetermined pattern and in parallel spaced relation to each other extend through respective openings formed in the insulating support. Front ends or portions of the contacts respectively engage opposing contacts of a mating connector.

The device includes a grounding wafer or electrically conductive disc slidably inserted into a front shell portion of the connector, and thus between opposing front shells of mating connectors. An outer periphery of the disc includes conductive fingers engaging an inner surface of the grounded front shell of the connector to thus ground the disc. The disc includes a plurality of holes arranged in the same predetermined pattern as the contacts so as to receive the contact front portions while the disc is installed in the front shell of the connector. The holes and contacts are sized to provide a clearance gap between the contacts and the disc. However, to ground a selected contact, conductive fingers are bonded to the disc around the periphery of the hole corresponding to the selected contact. The fingers extend toward and into grounding contact with the front portion of the selected contact.

The device disclosed in the '191 patent has several disadvantages. Specifically, the disc thickness is limited to approximately $^{30}/_{1000}$ of an inch to prevent interference between mating connectors. This structural limitation results in increased fragility and decreased reliability of the device. Also, a given disc has a limited application or adaptability because it can only be used with a connector having a matching contact arrangement. Requiring different discs for different contact arrangements drives up the cost and complexity of the disclosed grounding technique because each different disc must be fabricated using expensive, circuit card fabrication techniques. Often, the need arises for a field technician to retrofit or modify the present grounding configuration of a connector. Such field modification using the disclosed disc is extremely difficult without the provision of a suitably modified replacement disc. Also, the disc is so fragile that proper installation/removal of the disc is difficult, disadvantageously requiring specialized equipment.

U.S. Pat. No. 5,169,323 discloses another technique for grounding a contact in an electrical connector. An integrally formed grounding member is sandwiched between a connector shell, a first insulating support and a second insulating support for the contacts. The grounding member includes a grounding clip embedded in the first insulating support and contacting the contact. Installing and/or removing the grounding member disadvantageously requires connector disassembly. Also, the grounding member can only be used in a connector having contacts sized and arranged within the connector shell to coincide with the fixed dimensions of the integrally formed grounding member. Similar to the grounding disc disclosed in the '191 Patent, the integrally formed grounding member is neither adjustable, nor readily adaptable to alternative contact arrangements.

Thus, a need still exists, after connector assembly, for a device and technique to ground the one or more connector contacts without disassembling the electrical connector, using a simple, robust, adaptable, cost effective and easily installed electrical grounding device.

SUMMARY OF THE INVENTION

It is, therefore, an object of the present invention to selectively ground one or more electrical contacts of an assembled electrical connector without disassembling the electrical connector and without requiring special modification of the connector.

Another object of the present invention is to selectively ground one or more electrical contacts of an assembled connector either before or after electrical wires are connected to the contacts.

Yet another object of the present invention is to selectively ground contacts of electrical connectors having different contact arrangements but equivalent connector inner rear portion configurations using a grounding assembly of the present invention.

A further object of the present invention is to selectively ground contacts of different connectors having different inner rear portion configurations, including, for example, standardized (i.e., off-the-shelf), circular, rectangular, oval, and other more complicated configurations.

An even further object of the present invention is to selectively ground contacts of a connector without interfering with a mating interface between the connector and a mating connector.

Another object of the present invention is to simply, quickly, and cost effectively selectively ground contacts of an electrical connector.

Yet another object of the present invention is to selectively ground contacts of a connector using a grounding assembly having an improved robustness relative to prior art grounding devices.

Another object of the present invention is to selectively ground contacts of a connector, and to modify the selective grounding of such contacts, using conveniently available, standardized tools, such as a screwdriver.

In accordance with the principles of the present invention, an assembly for selectively grounding one or more electrical contacts of a connector includes an elongate, continuously formed, electrically conductive ground insert configured to be inserted into and fixed within a connector rear portion. The ground insert includes a resilient outer periphery shaped to match an interior periphery of an inner wall of the connector rear portion. The outer periphery is sized and arranged to resiliently and frictionally engage the rear portion inner wall to thereby fix and electrically connect the ground insert to the inner wall. The ground insert includes an inner periphery defining a perimeter around and spaced from all of a plurality of contact back portions partially housed within the connector rear portion. The same ground insert can advantageously be used with different connectors having different contact arrangements but the same rear portion interior shape and size because the different contact arrangements do not interfere with the ground insert. The ground insert, including a rigid metal frame and a resilient metal conductor retained by the frame, is simple, yet robust, in construction. An alternative arrangement of the ground insert includes a split configuration of the ground insert having substantially identical halves that together form the above described ground insert inner and outer peripheries. The split configuration advantageously permits a user to install the ground insert into a rear portion after wires are connected to the contact back portions.

The assembly also includes a simple and sturdy, electrically conductive, grounding bridge or leg having first and second spaced ends respectively fastenable to the ground insert and a contact back portion to establish an electrical connection between the contact and the rear portion through the grounding leg and the ground insert. The first end of the grounding leg is fastened to the ground insert using a simple fastening device, such as a screw, which is conveniently installed/removed using a screwdriver. The first end of the grounding leg includes an elongate hole for receiving the screw, and to automatically compensate for variations in the separation between the contact back portion and the rear portion inner wall. An opening in the rear portion provides convenient access to the rear portion interior and to the contact back portions to enable easy initial installation, retrofits, and removal of the assembly by a user of the assembly, without disassembly of the connector itself.

The foregoing objects are also achieved by an assembly for selectively grounding at least one electrical contact of an electrical connector to a rear portion of the connector, the connector including a plurality of electrical contact back portions at least partially housed within the rear portion and accessible through an opening in the rear portion. The assembly comprises an electrically conductive ground insert including an outer periphery sized and shaped to engage an inner wall of the rear portion to thereby fasten and electrically connect the ground insert to the rear portion. The assembly also includes an electrically conductive grounding leg having first and second spaced ends adapted and arranged to be respectively fastened to the ground insert and a back portion of the at least one electrical contact to thereby provide an electrical ground path between the electrical contact and the rear portion of the connector. A fastener is used to fasten the first end of the grounding leg to the ground insert while the ground insert is fastened to the connector rear portion.

The foregoing objects are also achieved by an assembly comprising an electrically conductive ground insert that includes an annular frame having a cylindrically shaped inner wall defining a circumferential perimeter around and spaced from a plurality of contact back portions. The frame defines a circumferentially extending outer channel and a side slot, and includes an upper rim accessible through the rear portion opening while the ground insert is within the rear portion. The upper rim includes at least one aperture. The assembly also includes a circumferentially extending resilient fastener which includes a retained portion and a resilient skirt contiguous with the retained portion. The retained portion is compressively retained within the channel and entrapped within the channel by the frame, and the resilient skirt extends through and beyond the side slot of the frame to form a resilient, circumferentially extending, outer periphery of the ground insert. The resilient outer periphery is adapted and arranged to resiliently engage the inner wall of the connector to thereby fix and electrically connect the ground insert to the rear portion inner wall. The assembly also includes an electrically conductive grounding leg having an elongate body and including a first end and a second end spaced from the first end. The first end includes an elongate through aperture, and the second end includes an apertured spring grip mechanism for resiliently engaging and electrically contacting a contact back portion of the at least one contact. The assembly also includes a threaded fastener for fastening the grounding leg to the ground insert to complete an electrical grounding path between the contact back portion and the rear portion through the grounding leg. The elongate through aperture of the grounding leg is sized to receive the fastener, and the at least one aperture of the ground insert is sized to receive the threaded fastener such that the threaded fastener threadingly engages the ground insert to thereby fasten the first end of the grounding leg to the ground insert.

The foregoing objects are also achieved by an a connector and grounding assembly comprising a connector that includes a connector housing. The connector housing includes a connector rear portion having an inner wall defining a rear portion interior and an opening into the rear portion interior. The connector also includes an insulating support fixed to and within the connector housing and a plurality of electrical contacts fixed in position by the insulating support. Each of the electrical contacts includes a contact back portion, commonly referred to as a contact wire bucket, extending away from the insulating support and into the rear portion interior, and the contact back portions are positioned in spaced parallel relation to each other and the connector rear portion inner wall. The assembly also includes an electrical contact grounding assembly including an electrically conductive ground insert having an outer periphery sized and shaped to engage the rear portion inner wall to thereby fasten and electrically connect the ground insert to the rear portion. The contact grounding assembly also includes an electrically conductive grounding leg having first and second spaced ends adapted and arranged to be respectively fastened to the ground insert and a back portion of one of the electrical contacts to thereby provide an electrical ground path between the one of the electrical contacts and the rear portion of the connector. The contact grounding assembly also includes a fastener for fastening the first end of the grounding leg to the ground insert while the ground insert is fastened to the connector rear portion.

The foregoing objects are also achieved by a method of selectively grounding at least one electrical contact of an electrical connector. The method includes fixing an electrically conductive ground insert to an inner wall of the rear portion of the connector to electrically connect the ground insert to the rear portion and establish an outer perimeter around and spaced from the plurality of contact back portions. The method also includes the steps of fastening a first end of an electrically conductive grounding leg to a fastening site of the ground insert using a fastener, and coupling a second end of the grounding leg to the contact back portion to thereby establish an electrical grounding path between the contact back portion and the rear portion through the grounding leg and the ground insert.

Still other objects and advantages of the present invention will become readily apparent to those skilled in the art from the following detailed description, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

FIG. 4A is a perspective view of a first embodiment of the grounding leg of the selective grounding assembly of FIG. 1A;

FIG. 4B is a side view of the grounding leg of FIG. 4A;

FIG. 4C is a side view of a spring grip mechanism of the grounding leg of FIG. 4A;

FIG. 5A is a top view of a second embodiment of a grounding leg of the selective grounding assembly in accordance with the present invention;

FIG. 5B is a side view of the grounding leg of FIG. 5A;

FIG. 6A is a perspective view wherein a contact back portion of the connector of FIG. 1A, a wire, and the grounding leg of FIG. 4A threaded onto the wire, are depicted, before the wire is connected to the contact back portion;

FIG. 6B is similar to FIG. 6A, with the exception that the wire is depicted connected to the contact back portion and the spring grip mechanism of the grounding leg is depicted coupled to the contact back portion;

BEST MODE FOR CARRYING OUT THE INVENTION

Figure 1A:
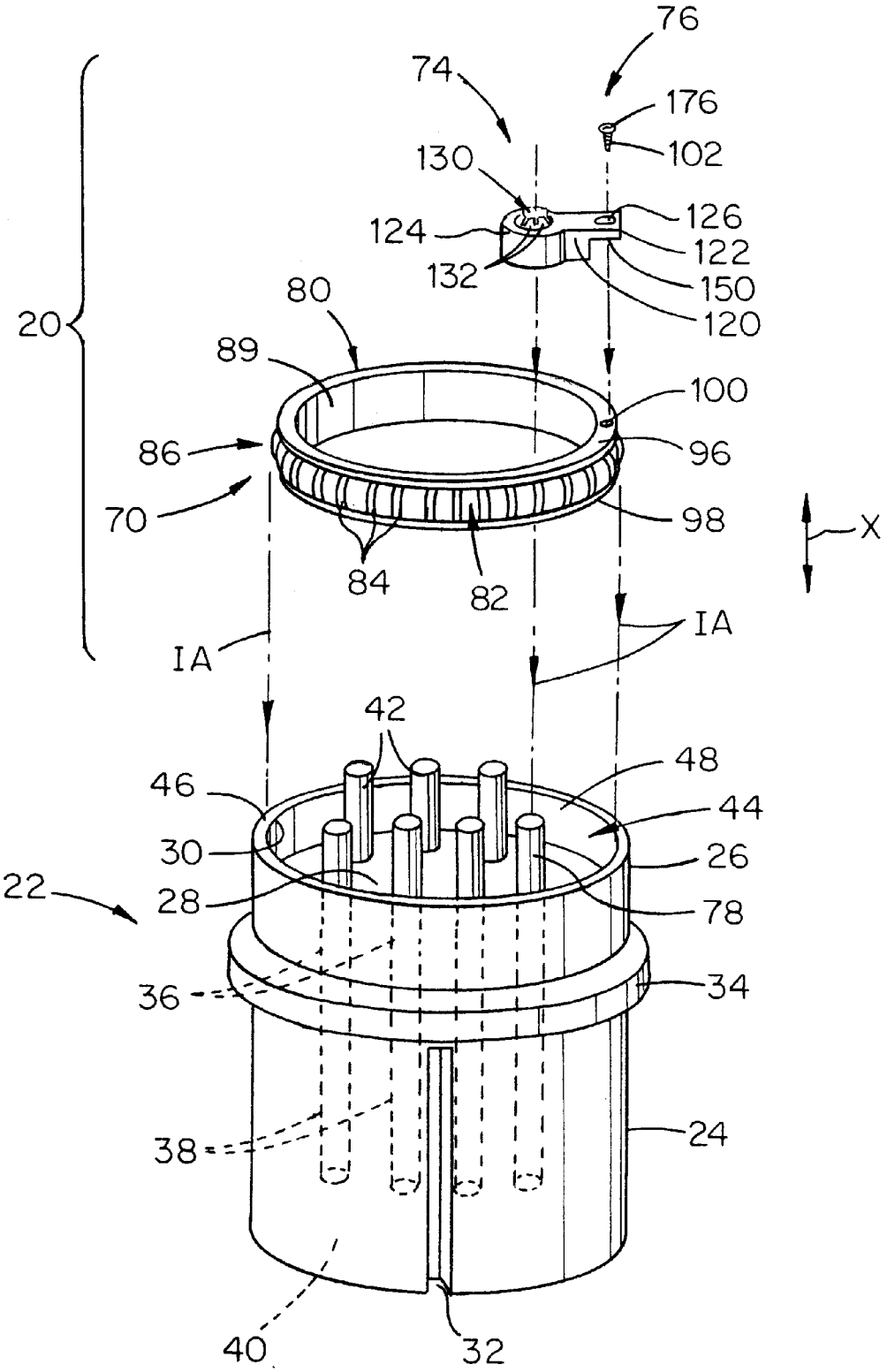
FIG. 1A is an exploded perspective view of a known, standardized connector and an embodiment of a selective grounding assembly in accordance with the present invention, wherein the grounding assembly is depicted in a disassembled configuration and prior to being installed within a rear portion of the connector.

With reference to FIG. 1A, a selective grounding assembly 20 constructed in accordance with the principles of the present invention, is depicted. For convenience, terms such as "above", "below", "right" and "left", as used herein, are to be construed in the relative sense. The selective grounding assembly 20 is depicted before its installation into an exemplary electrical connector 22. Before the present invention is described, a brief description of the known electrical connector 22 is provided. The electrical connector 22 is a commonly known, standardized type of electrical connector including a cylindrically shaped front shell 24 and a cylindrically shaped metal rear portion 26. It is to be understood that a cylindrically shaped connector is described herein for convenience and any configuration including square, rectangular, oval, and cylindrical can be used with the present invention. Known electrical connector 22 includes an insulating support 28 housed within rear portion 26 and fixed to an inner cylindrically shaped wall 30 of rear portion 26. An axially (i.e., vertically) directed guide slit or groove 32 is formed in an outer surface of front shell 24 and serves as a mating guide for a front shell portion of a mating connector (not shown). Also, a circumferentially extending external flange 34 is formed on the outer surface of front shell 24 for stopping the front shell portion of the mating connector and compressing a seal between the mating connectors.

Connector 22 includes a plurality of elongate contacts 36 extending in an axial, i.e., vertical, direction X through electrically insulating support 28, and in parallel spaced relation to each other and rear portion inner wall 30. Contacts 36 extend through and are fixed in position by insulating support 28. Contacts 36 include respective front ends or portions 38 extending into an inner space or volume 40 defined by front shell 24. Contact front portions 38 include either contact insertion pins or receiving sockets (not shown) for respectively engaging opposing sockets or pins of the mating connector, as is known. It is to be understood that connector 22 can include any number of electrical contacts 36 depending on the application of the connector, and moreover, that such contacts may be positioned in alternative patterns as desired within the connector.

Contacts 36 include respective back portions or wire buckets 42 extending into a rear portion interior 44 defined by inner wall 30 of rear portion 26. An upper peripheral edge 46 of inner wall 30 defines an access way or opening 48 through which the interior 44 and contact back portions 42 are readily accessible. In this manner, contact back portions 42 are at least partially housed within rear portion 26. Each of the contact back portions 42 forms a wire receiving receptacle as is well known, such as a solder well or crimp receptacle, for receiving a conductor wire (not shown). Such wires are connected to back portions 42 by soldering or crimping the wires to the receiving receptacles, in a known manner.

Now, grounding assembly 20 of the present invention is described. Unique grounding assembly 20 is conveniently, quickly, and easily applied to connector 22 to selectively ground one or more of the contacts 36, as will be described in detail below. The phrase "selectively ground" should be taken to mean that a user of grounding assembly 20 selects at least one of the contacts 36 to be grounded, and then applies grounding assembly 20 to connector 22 to thereby ground the at least one selected contact.

The construction of grounding assembly 20 is simple and cost effective, yet sturdy and highly reliable. Grounding assembly 20 is advantageously useable with connector rear portion 26, regardless of the number and spatial arrangement of electrical contacts 36 within connector 22, so long as the electrical contacts are suitably spaced from inner wall 30, as will be described below. Grounding assembly 20 includes an annular, electrically conductive ground insert 70, an elongate, electrically conductive grounding leg 74, and a fastener 76 for securely fastening grounding leg 74 to ground insert 70.

Figure 1C:
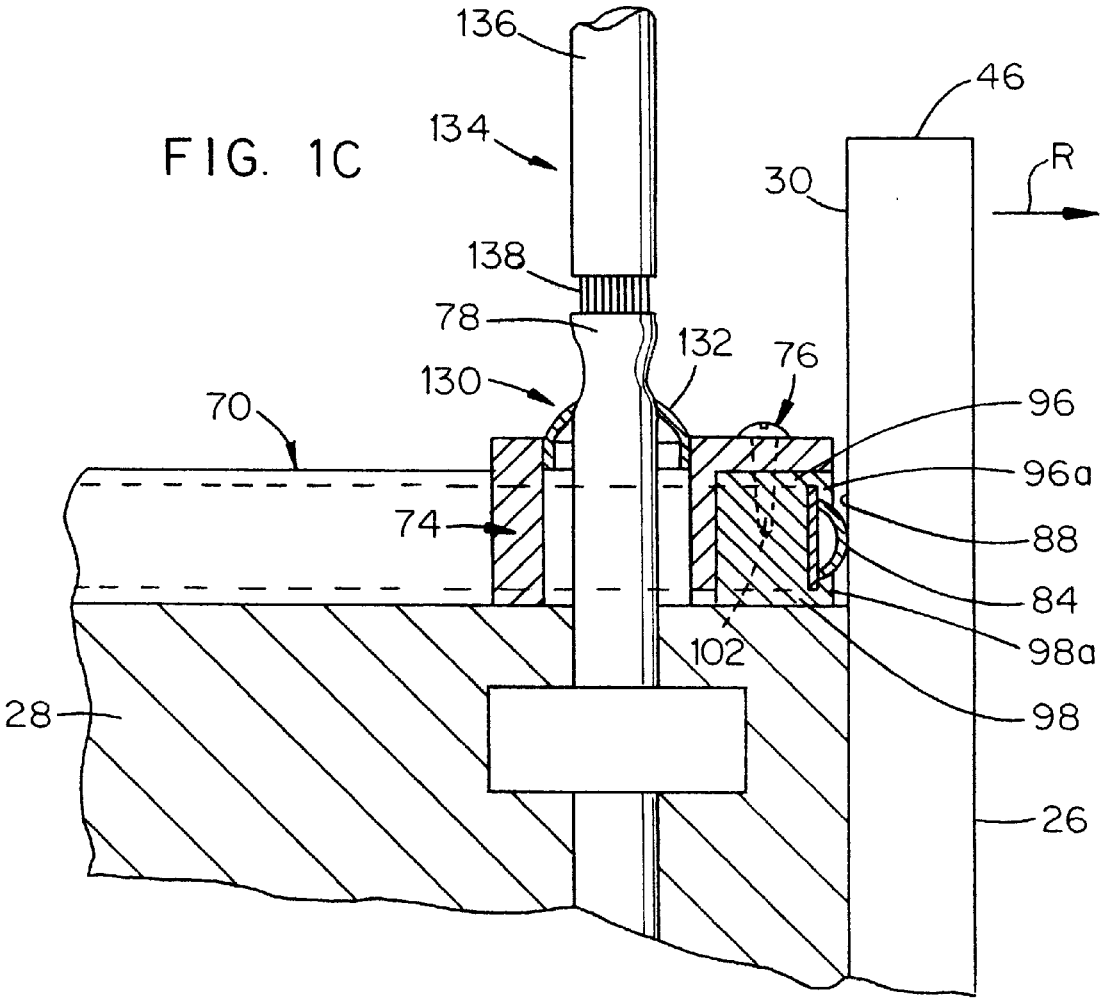
FIG. 1C is a partial cross-sectional view of the connector and the selective grounding assembly of FIG. 1B taken along the line 1C—1C.
Figure 1B:
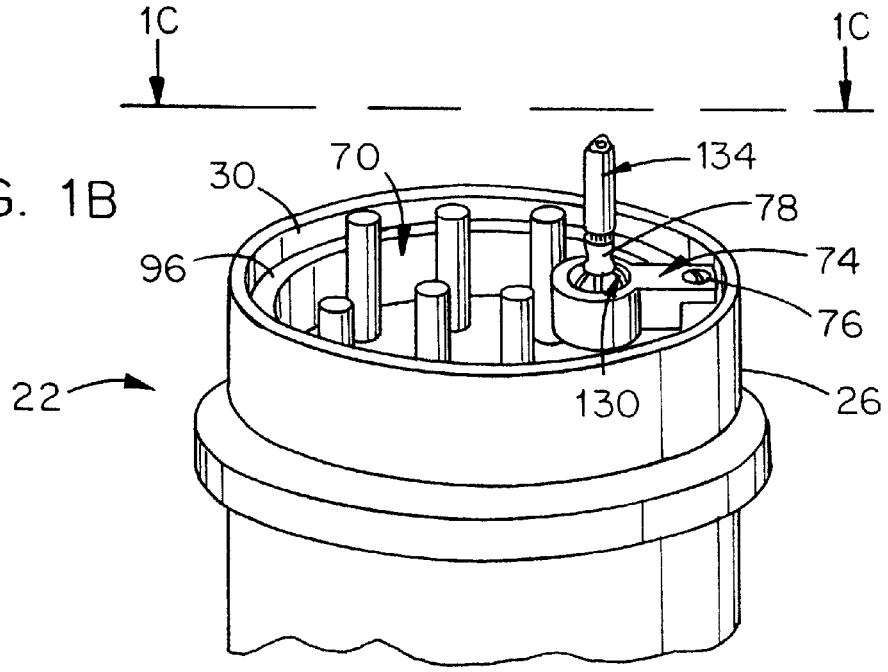
FIG. 1B is a perspective view of the connector of FIG. 1A and the grounding assembly of FIG. 1A, wherein the grounding assembly is depicted in an assembled configuration and operatively installed within the rear portion of the connector to ground a contact of the connector.

Ground insert 70 is configured to be inserted into and securely retained by rear portion 26 of connector 22. Ground insert 70 is depicted in FIGS. 1B and 1C as occupying an operatively inserted position within rear portion interior 44 to thereby ground a selected one of the contacts of connector 22, as will be more fully described later. To ground a selected one of the contacts 36 with selective grounding assembly 20, ground insert 70 is inserted into rear portion 26 (as indicated by insertion alignment arrows IA in FIG. 1A), and grounding leg 74 is fastened between ground insert 70 and a grounding contact back portion 78 corresponding to the selected one of the contacts 36 to be grounded, as depicted in FIGS. 1B and 1C. An electrical ground connection is established between grounding contact back portion 78 and rear portion 26 through selective grounding assembly 20.

Selective grounding assembly 20 is now described in detail, still with reference to FIGS. 1A–1C. Ground insert 70 of selective grounding assembly 20 includes a rigid, annular frame 80 and a resilient fastener 82 retained by frame 80. Resilient fastener 82 includes a circumferentially-extending series of parallel, spaced, resilient ridges 84, each of which extends in a vertical direction. The series of ridges 84 collectively form a resilient, circumferentially extending, outer periphery or resilient skirt 86 of ground insert 70, conforming in shape to a peripheral portion 88 (see FIG. 1C) of rear portion inner wall 30. While ground insert 70 is removed or separated from rear portion 26, as depicted in FIG. 1A, resilient skirt 86 defines an outer diameter of ground insert 70 that is only slightly larger than an inner diameter of rear portion 26 defined by rear portion inner wall 30.

Accordingly, when ground insert 70 is inserted into or installed in rear portion 26 as depicted in FIGS. 1B and 1C, inner wall 30 of rear portion 26 compresses resilient skirt 86 inwardly against a resilient biasing force of the skirt 86. As a result, skirt 86 resiliently and frictionally engages inner wall 30 to thereby securely fix ground insert 70 to and within rear portion 26. Such contact between ground insert 70 and inner wall 30 of rear portion 26 provides an electrical contact path from ground insert 70 to rear portion 26. It should be appreciated that frictional and electrical engagement between rear portion inner wall 30 and ground insert 70 is advantageously maximized in the present invention because ground insert 70 is constructed such that the outer periphery (i.e., resilient skirt 86) of ground insert 70 has the same shape as inner wall 30.

Annular frame 80 of ground insert 70 includes a rigid inner side wall 89 concentrically arranged with respect to resilient skirt 86. The diameter of inner wall 89 is such that inner wall 89 forms a perimeter or border around and spaced from all of the contact back portions 42, while ground insert 70 is inserted into rear portion 26 (as depicted in FIGS. 1B and 1C). An advantage of ground insert 70 over prior art devices, such as the disc in the '191 patent, is that ground insert 70 can be used with a given rear portion 26 regardless of the spatial arrangement of the contact back portions 42 housed by rear portion 26.

Rigid, annular frame 80 of ground insert 70 is of unitary construction, and is made from an electrically conductive metal by any suitable method, such as die casting or machining from a block of metal stock. Annular frame 80 includes an upper annular rim 96 and an opposing lower annular rim 98, axially spaced from upper annular rim 96, both extending from wall 89 in an outward radial direction R, as depicted, for example, in FIG. 1C. To enable ground insert 70 to be inserted into rear portion 26, an outer diameter of annular frame 80, defined by rims 96,98 is slightly less than the diameter of rear portion inner wall 30. Lower annular rim 98 of annular frame 80 abuts or is flush against a periphery of insulating support 28 adjacent inner wall 30 (of rear portion 26), while ground insert 70 is fully inserted within rear portion 26.

A fastening site 100 provided in upper annular rim 96 includes a drilled, tapped hole, sized to receive a threaded portion 102 of fastener 76. The drilled, tapped hole of fastening site 100 extends through upper rim 96 and into side wall 89 of annular frame 80. Upper rim 96 and thus fastening site 100 are conveniently accessible through rear portion opening 48 while ground insert 70 is installed within rear portion 26, as depicted in FIGS. 1B and 1C. Advantageously, the tapped hole is reusable and it should be understood that any type of reusable fastener can be used in the present invention.

Figure 2:
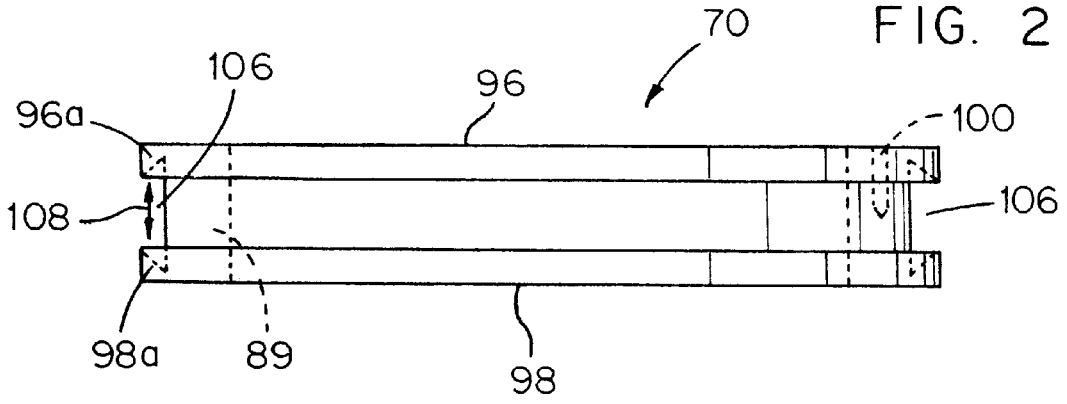
FIG. 2 is a side elevational view of a frame component of an embodiment of a ground insert of the grounding assembly of FIG. 1A.

With reference to FIG. 2, there is depicted a side elevational view of annular frame 80, while frame 80 is separated from resilient fastener 82, i.e., prior to assembly of ground insert 70. With reference to FIGS. 1C and 2, rims 96,98 and wall 89 of annular frame 80 define a circumferentially extending, outer channel 106 for receiving and captively retaining a portion of resilient fastener 82, as will be described more fully below. A free end or lip 96*a* of upper rim 96 and a free end or lip 98*a* of lower rim 98 form an opposing pair of dove-tail shaped lips for retaining resilient fastener 82. A circumferentially extending, peripheral gap or slot 108 is formed between the spaced pair of lips 96*a*,98*a* (best seen in FIG. 1C). Peripheral slot 108 has a vertical height, i.e., separation between spaced lips 96*a* and 98*a*, that is less than a vertical height of channel 106.

Figure 3A:
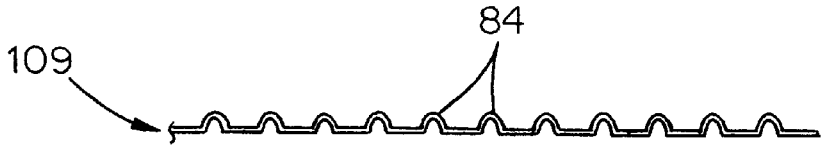
FIG. 3A is side view of a resilient fastener of the ground insert of FIG. 1A.
Figure 3B:
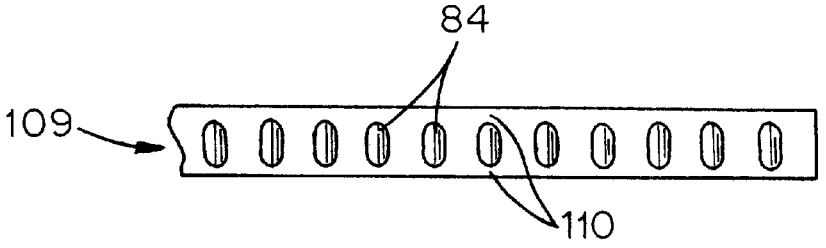
FIG. 3B is a top view of the resilient fastener of FIG. 3A.

As previously mentioned, ground insert 70 also includes resilient fastener 82. Resilient fastener 82 is retained by frame 80 and forms resilient skirt 86, described above. With reference to FIGS. 3A and 3B, there is depicted resilient fastener 82 while separated from frame 80, i.e., prior to assembly of ground insert 70. Before being formed into annular resilient fastener 82, fastener 82 is formed from a resilient, generally flat, rectangularly shaped strip 109 of conductive metal, such as spring steel. Strip 109 includes ridges 84 spaced along a full length of strip 109. Ridges 84 can be formed by known processes, such as by pressing or stamping dimples into an originally flat side of strip 109.

Once formed into an annular shape and installed within channel 106 of annular frame 80, fastener 82 has a vertical height and a length respectively sized relative to the vertical height and a circumferential length of channel 106 of annular frame 80 such that a periphery 110 (see FIG. 3B) of resilient fastener 82 is snugly received within and along substantially the full circumferential length of channel 106, whereby periphery 110 of fastener 82 is entrapped or captively retained within channel 106 by opposing lips 96*a*,98*a*, as depicted in FIG. 1C. On the other hand, ridges 84, having a vertical height slightly less than the vertical height of slot 108, extend through and beyond gap 108, to collectively form resilient skirt 86, while fastener 82 is retained within channel 106 of frame 80.

It is to be understood that other configurations and arrangements of annular frame 80 and resilient fastener 82 are possible without departing from the spirit and scope of the present invention. For example, resilient fastener 82 can include one or more circumferentially-extending ridges for engaging inner wall 30, instead of vertical, spaced ridges 84. Also, protruding ridges 84 can be produced by 1) stamping out sections of spring strip 109, and 2) inserting stamped strip 109 into channel 106 whereby ridges 84 are formed by bowed portions of the strip extending or bulging through side slot 108. Additionally, the specific manner by which resilient fastener 82 is retained by frame 80, e.g., the configuration of peripheral channel 106 formed by rims 96,98 and the retained portion (periphery 110) of fastener 82, can be provided in alternative interlocking configurations, as needed.

With reference again to FIG. 1A, grounding assembly 20 includes grounding leg 74. Grounding leg 74 has a generally elongate body 120 including a first end 122 configured to be fastened to ground insert 70, and a second end 124 configured to engage a contact back portion. First end 122 includes an elongate through aperture 126 for receiving threaded portion 102 of fastener 76, used to fasten first end 122 to fastening site 100 of ground insert 70. Second end 124 includes a spring grip mechanism 130, which includes a plurality of resilient tines 132, for gripping a contact back portion (e.g., grounding contact back portion 78).

Through aperture 126 and spring grip mechanism 130 of grounding leg 74 are spaced a predetermined distance from each other to respectively coincide with fastening site 100 of ground insert 70 and grounding contact back portion 78, while grounding leg 74 is operatively positioned to ground grounding contact back portion 78, as depicted in FIGS. 1B and 1C. Elongate through aperture 126 conveniently permits adjustable positioning of grounding leg 74, and specifically first end 122, relative to fastening site 100 to thereby accommodate variations in the distance between the rear portion inner wall 30 and grounding contact back portion 78.

As depicted in FIGS. 1B and 1C, to complete an electrical path between rear portion 26 and grounding contact back portion 78, first end 122 of grounding leg 74 is fastened to ground insert 70 by fastener 76, while tines 132 of spring grip mechanism 130 grip an outer periphery of grounding contact back portion 78. The electrical path is thus established between grounding contact back portion 78 and rear portion 26 through connected grounding leg 74 and ground insert 70. The electrical path becomes an electrical ground path while the connector rear portion is itself grounded by any mechanism (not shown). In FIGS. 1B and 1C, grounding contact back portion 78 is depicted as being crimp-connected to an electrical wire 134. Wire 134 includes an insulating jacket 136 and an inner conductor 138. Insulation is stripped from conductor 138 to permit an electrical connection between grounding contact back portion 78 and conductor 138, as is known. Accordingly, installing grounding assembly 20 as depicted in FIGS. 1B and 1C electrically grounds both grounding contact back portion 78 and conductor 138 connected grounding contact to back portion 78.

While only a single contact is depicted grounded in FIGS. 1B and 1C, it is to be understood that any number of contacts can be grounded as desired using grounding assembly 20, by providing a fastening site 100 and a grounding leg 74 for each contact to be grounded.

Grounding leg 74 is now described in further detail, with particular reference to FIGS. 4A, 4B and 4C. Grounding leg 74, depicted in an assembled configuration in FIG. 4A, includes two separable components, namely 1) elongate body 120, depicted in FIG. 4B, and 2) spring grip mechanism 130, depicted in FIGS. 4A and 4C. With reference to FIGS. 4A and 4B, elongate body 120 is made from an electrically conductive metal by any known method, such as die casting or machining from a block of metal stock. First end 122 of body 120 includes a recessed ledge portion 150 sized and shaped to rest flush against upper rim 96 and inner wall 89 or frame 80 (see FIG. 1C).

Second end 124 of body 120 includes a through aperture 152 for receiving spring grip mechanism 130. Spring grip mechanism 130 is sized and shaped to be inserted into through aperture 152 and to frictionally engage a wall 156 of elongate body 120 defining through aperture 152. To assemble grounding leg 74, spring grip mechanism 130 is press fit into through aperture 152 and held in place by friction between a periphery of spring grip mechanism 130 and wall 156.

Spring grip mechanism 130 includes the plurality of resilient spring fingers or tines 132 extending from an upper periphery of through aperture 152 toward a central axis 160 of through aperture 152. Resilient tines 132 bend under the force of a contact back portion being inserted through through-aperture 152 and spring grip mechanism 130 to thereby make a sliding, removable, yet positive electrical connection with the contact back portion (see, for example, FIG. 1C).

In FIGS. 5A an 5B, there is depicted an alternative arrangement of a grounding leg 170. Unlike grounding leg 74, grounding leg 170 is of unitary or integral construction, and is formed using a metal stamping process. Grounding leg 170 includes an elongate body 172, an elongate through aperture 174 and a spring grip mechanism 176 spaced from the elongate through aperture, all of the foregoing elements being formed by the metal stamping process. Body 172 and elongate aperture 174 can be provided in an extended configuration, whereby body 172 is clipped to an appropriate length to ground a selected contact at the time grounding assembly 20 is installed.

As mentioned previously, grounding assembly 20 includes fastener 76 for fastening grounding leg 74 to fastening site 100 of ground insert 70. Fastener 76 can be any threaded fastener, such as a screw, having threaded lower portion 102 sized to threadingly engage annular frame 80 at fastening site 100. A head portion 176 of fastener 76 includes a standardized recess, such as a slot or "Phillips" style recess, as is known, for engaging the tip end of a corresponding standardized tool, such as a slotted or Phillips head screw driver. This enables grounding leg 74 to be conveniently fastened to or removed from ground insert 70 using fastener 76 and the standardized tool.

A method of selectively grounding a contact of connector 22 using selective grounding assembly 20 is now described. The method assumes an initial connector configuration as depicted in FIG. 1A, wherein 1) contacts 36 are already installed or fixed in insulator 28 and contact back portions 42 are solder buckets, and
2) no wires are connected to contact back portions 42 of connector 22.

A contact back portion, e.g., grounding contact back portion 78, is identified as corresponding to the selected one of the contacts 36 to be grounded. Next, a user installs assembly 20 by first inserting or press fitting ground insert 70 into rear portion interior 44. The user gains access into interior 44 through rear portion opening or access way 48. The user presses ground insert 70 into the fully installed position within rear portion 26, as depicted in FIGS. 1B and 1C, with fastening site 100 positioned relative to grounding contact back portion 78 so that grounding leg 74 can be fastened between fastening site 100 and grounding contact back portion 78.

The next step of the installation process is described with reference to FIG. 6A, wherein electrical wire 134 is depicted prior to being connected to grounding contact back portion 78. Prior to connecting conductor 138 of wire 134 to grounding contact back portion 78, wire 134 is pushed through spring grip mechanism 130 of grounding leg 74, as depicted in FIG. 6A. It should be appreciated that the user may be unable to thread spring grip mechanism 130 over insulating jacket 136 as depicted in FIG. 6A because spring grip mechanism 130 may be too small to accommodate a relatively large diameter of wire 134 at insulating jacket 136. In such circumstances, the user threads spring grip mechanism 130 on to conductor 138 and up to, but not over, insulating jacket 136.

The next steps of the installation process are described with reference to FIG. 6B, wherein conductor 138 of wire 134 is depicted connected grounding to contact back portion 78. After threading grounding leg 74 onto wire 134 and connecting conductor 138 to grounding contact back portion 78, the user slides grounding leg 74 toward and over grounding contact back portion 78, thus bringing resiliently biased tines 132 into contact with grounding contact back portion 78, as described above, and as depicted in FIGS. 1B, 1C and 6B. Next, the user fastens first end 122 of grounding leg 74 to fastening site 100 using fastener 76 and a standardized tool, such as screw driver. Elongate aperture 126 of grounding leg 74 automatically accommodates variations in the separation between grounding contact back portion 78 and fastening site 100.

The above method is slightly different if contact back portions 42 are crimp-style wire buckets instead of solder buckets. In this case, contacts 36 are initially separate from connector 22. The user first threads grounding leg 74 on to wire 134, and then crimp connects grounding contact back portion 78 to conductor 138. Next the user installs the contact corresponding to grounding contact back portion 78 into insulator 28, and then slips spring grip mechanism 130 over and into contact grounding with contact back portion 78.

Disassembling an installed grounding assembly 20 is straightforward in comparison to, for example, disassembling the prior art grounding devices disclosed in the '191 and '323 patents, discussed above, because connector 22 need not be disassembled and no special equipment is needed. Instead, in the present invention, fastener 76 is conveniently removed using, for example, a screw driver. After removing fastener 76, grounding leg 74 is removed from grounding contact back portion 78 of connector 22, for example, by clipping grounding leg 74 with a wire cutter, or by removing a soldered wire. Ground insert 70 can then be pulled from respective rear portion 26 or 220 to thereby separate the ground insert from the respective rear portion.

Figure 7A:
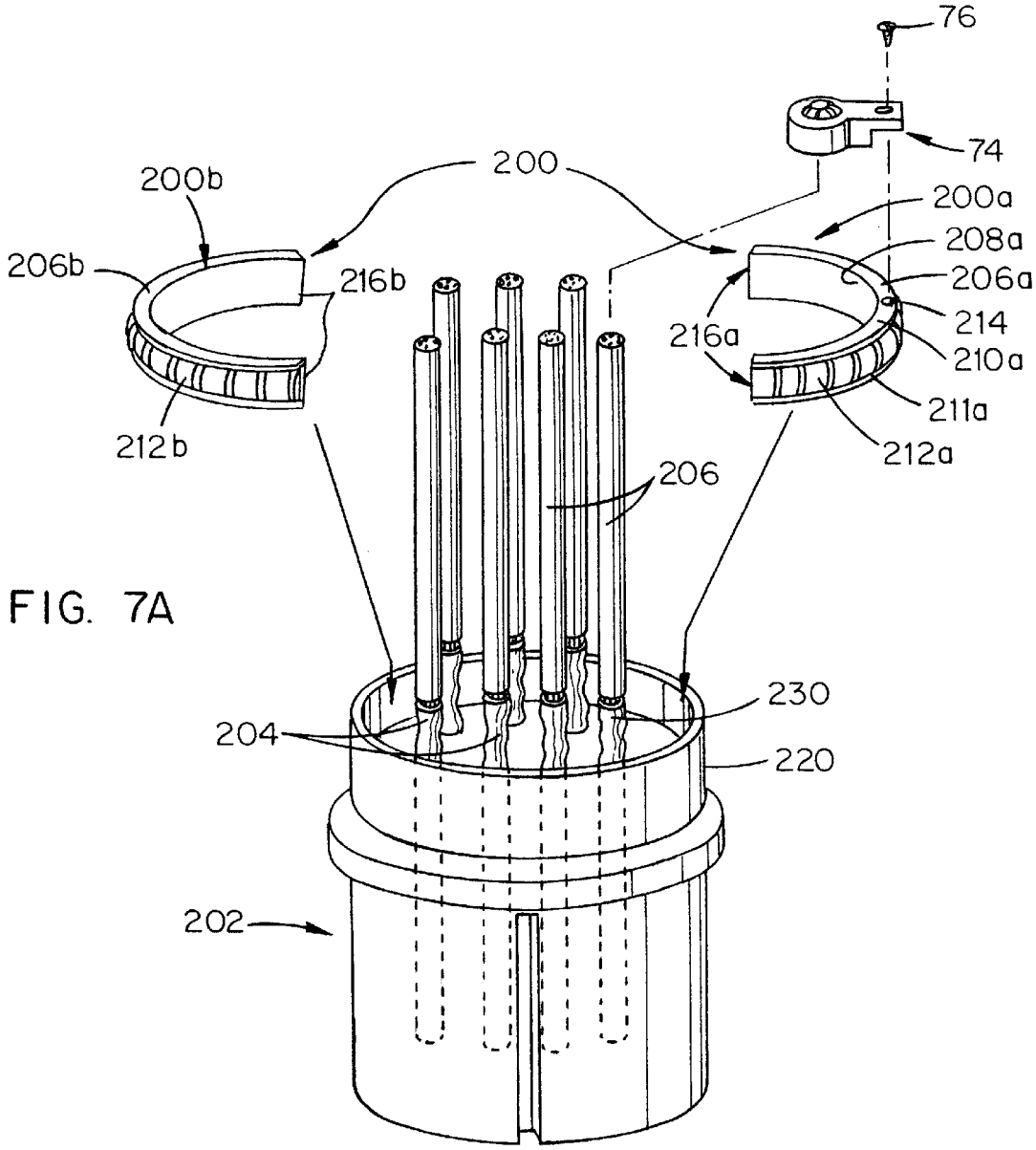
FIG. 7A is an exploded perspective view of a known connector having wires connected to the contact back portions of contacts installed in the connector, and an alternative arrangement of the ground insert in accordance with the present invention, wherein the ground insert is depicted prior to being installed within the connector.
Figure 7B:
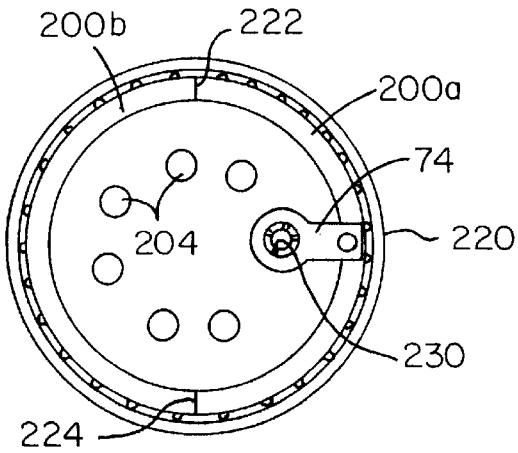
FIG. 7B is a plan view of the connector and ground insert of FIG. 7A, wherein the ground insert is depicted operatively installed within the connector.

The installation method described above with reference to contact back portions having solder buckets is simplified by installing ground insert 70 into rear portion 26 before wires are connected to contact back portions 42. Specifically, ground insert 70 forms a closed ring that would otherwise have to be threaded past or over wires connected to back portion 42. However, it is often necessary to selectively ground contacts in a connector having contact back portions previously connected to wires. Accordingly, there is depicted in FIGS. 7A and 7B, an alternative arrangement of a ground insert 200. Ground insert 200 is particularly suited for selectively grounding at least one contact of a. connector 202 having back portions 204 previously connected respectively to wires 206. Connector 202 is the same as connector 22 described earlier, with the exception that wires 206 are connected to contact back portions 204 of connector 202, before beginning the selective grounding process.

Ground insert 200 has a split ring configuration that would be formed, essentially, by cutting previously described ground insert 70 into a pair of nearly identical semi-circular ground insert portions. With reference to FIGS. 7A and 7B, ground insert 200 includes a semi-circular, right or first ground insert 200*a*, and a nearly identical, semi-circular, left or second ground insert 200*b*. In FIGS. 7A and 7B, like components of right and left ground inserts 200*a*,200*b* are designated with like numerals containing the respective further (suffix) designations "a" or "b".

Right ground insert 200*a* includes a metal frame 206*a*, an inner wall 208*a*, upper and lower spaced rims 210a,211a, a resilient fastener 212*a* retained between the upper and lower rims, and a fastening site 214 formed at upper rim 210*a*. The foregoing components of right ground insert 210*a* are constructed and arranged substantially as described with reference to correspondingly named components of ground insert 70, previously described, with the exception that the elements of ground insert 200*a* form an elongate, semi-circular or semi-annular ground insert, instead of an annular ground insert. Also unlike ground insert 70, frame 206*a* of right ground insert 200*a* includes a pair of spaced free ends 216*a*.

Left ground insert 200*b* has an identical configuration to right ground insert 200*a*, except left ground insert does not include a fastening site, as depicted. However, it is to be understood that fastening sites are provided wherever necessary along left and right inserts 200*a*,200*b* to selectively ground one or more contact back portions 204.

Right and left ground inserts 200*a*,200*b* are sized to form a segmented annular ring, when inserted together into a rear portion 220 of connector 202, as depicted in FIG. 7B. While installed within rear portion 220, opposing ends 216*a* of right ground insert 200*a* abut respectively opposing ends 216*b* of left ground insert 200*b*, to form diametrically opposing seams 222 and 224. Right and left ground inserts 200*a*,200*b* thus form a composite, annular insert frictionally and resiliently retained within rear portion 220, in the same manner ground insert 70 is retained within rear portion 26 of connector 22.

The method of selectively grounding a contact back portion, e.g., contact back portion 230, of connector 202 includes installing ground insert 200 directly into connector rear portion 220, e.g., one half at a time, while contact back portions 204 are connected to wires 206. Also, the wire connected to contact back portion 230 must be disconnected, e.g., unsoldered, from the contact back portion so that grounding leg 74 can be threaded onto the wire, as previously described. The remaining steps of the method are the same as those previously described.

Since connector rear portions come in many different sizes and shapes, such as square, rectangular, oval, and cylindrical (e.g., rear portion 26) shapes, it is to be understood that alternative corresponding shapes of the ground insert of the present invention are envisioned in addition to the exemplary annular shape of ground inserts 70 and 200. For each of the alternatively shaped ground inserts, it is important that the:

1) outer periphery of the ground insert (e.g., resilient skirt 86) conforms to the shape (e.g., square, rectangle, etc.) of the rear portion inner periphery (e.g., inner wall 30); and 2) inner wall of the ground insert (e.g., wall 89 of frame 80) establishes a perimeter around and spaced from all of the connector contacts, as described above.

An assembly for and method of selectively grounding one or more contacts of a connector has been described. The simple, cost effective, yet robust assembly includes a ground insert, a grounding leg and a fastener, as described above. Using the assembly of the present invention, one or more contacts of the connector are advantageously grounded without disassembling the connector. Also, an assembly in accordance with present invention, configured for use with a given rear portion, can be used with that rear portion regardless of the contact arrangement within the rear portion.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An assembly for selectively grounding at least one electrical contact of an electrical connector to a rear portion of the connector, the connector including a plurality of electrical contact back portions at least partially housed within the rear portion and accessible through an opening in the rear portion, said assembly comprising:

an electrically conductive ground insert including an outer periphery being sized and shaped to engage an inner wall of the rear portion to thereby fasten and electrically connect the ground insert to the rear portion;

an electrically conductive grounding leg having first and second spaced ends being adapted and arranged to be respectively fastened to the ground insert and a back portion of the at least one electrical contact to thereby provide an electrical ground path between the electrical contact and the rear portion of the connector; and a fastener for fastening the first end of the grounding leg to the ground insert while the ground insert is fastened to the connector rear portion;

wherein the ground insert includes an inner periphery being sized and shaped to define a perimeter around and spaced from the plurality of electrical contact back portions;

wherein the ground insert includes a fastening site, the first and second spaced ends of the grounding leg being spaced by a predetermined distance to respectively coincide with the fastening site of the ground insert and the back portion of the at least one contact while the grounding leg is operatively positioned to ground the at least one contact; and wherein the first end of the grounding leg includes an elongate through aperture for receiving the fastener and to enable adjustable positioning of the first end of the grounding leg relative to the fastening site of the ground insert to thereby accommodate variations in a distance between the rear portion inner wall and the contact back portion of the at least one contact.

2. The assembly of claim 1, wherein the ground insert includes an upper surface accessible through the rear portion opening while the ground insert is fixed within the rear portion, the fastening site coinciding with the upper surface of the ground insert.

3. The assembly of claim 2, wherein the fastener is a screw and the fastening site includes an aperture formed in the upper surface of the ground insert and sized to receive a threaded end of the screw.

4. An assembly for selectively grounding at least one electrical contact of an electrical connector to a rear portion of the connector, the connector including a plurality of electrical contact back portions at least partially housed within the rear portion and accessible through an opening in the rear portion, said assembly comprising:

an electrically conductive ground insert including an outer periphery being sized and shaped to engage an inner wall of the rear portion to thereby fasten and electrically connect the ground insert to the rear portion;

an electrically conductive grounding leg having first and second spaced ends being adapted and arranged to be respectively fastened to the ground insert and a back portion of the at least one electrical contact to thereby provide an electrical ground path between the electrical contact and the rear portion of the connector; and a fastener for fastening the first end of the grounding leg to the ground insert while the ground insert is fastened to the connector rear portion;

wherein the ground insert includes an inner periphery being sized and shaped to define a perimeter around and spaced from the plurality of electrical contact back portions;

wherein the ground insert includes a fastening site, the first and second spaced ends of the grounding leg being spaced by a predetermined distance to respectively coincide with the fastening site of the ground insert and the back portion of the at least one contact while the grounding leg is operatively positioned to around the at least one contact; and wherein the ground insert is split into a pair of substantially identical opposing segments, the opposing segments together forming the inner and outer peripheries of the ground insert while the opposing segments are fixed within the rear portion in abutting relation to each other.

5. An assembly for selectively grounding at least one electrical contact of an electrical connector to a rear portion of the connector, the connector including a plurality of electrical contact back portions at least partially housed within the rear portion and accessible through an opening in the rear portion, said assembly comprising:

an electrically conductive ground insert including an outer periphery being sized and shaped to engage an inner wall of the rear portion to thereby fasten and electrically connect the ground insert to the rear portion;

an electrically conductive grounding leg having first and second spaced ends being adapted and arranged to be respectively fastened to the ground insert and a back portion of the at least one electrical contact to thereby provide an electrical ground path between the electrical contact and the rear portion of the connector; and a fastener for fastening the first end of the grounding leg to the ground insert while the ground insert is fastened to the connector rear portion;

wherein the ground insert includes an inner periphery being sized and shaped to define a perimeter around and spaced from the plurality of electrical contact back portions;

wherein the ground insert includes a fastening site, the first and second spaced ends of the grounding leg being spaced by a predetermined distance to respectively coincide with the fastening site of the ground insert and the back portion of the at least one contact while the grounding leg is operatively positioned to ground the at least one contact; and wherein the ground insert includes a resilient fastener, the resilient fastener including a resilient skirt forming the outer periphery of the ground insert, the resilient skirt having a shape conforming to the periphery of the inner wall of the rear portion, the resilient skirt resiliently and frictionally engaging the periphery of the inner wall of the rear portion while the ground insert is inserted into the rear portion to thereby fasten and electrically connect the ground insert to the inner wall.

6. The assembly of claim 5, wherein the ground insert includes a rigid frame having a wall forming the inner periphery of the ground insert.

7. The assembly of claim 6, wherein the rigid frame includes an outer periphery sized and shaped to establish a slight clearance gap between the rigid frame and the rear portion inner wall while the ground insert is fixed within the rear portion.

8. The assembly of claim 6, wherein the resilient fastener includes a retained portion contiguous the resilient skirt, the retained portion of the resilient fastener being captively retained by the rigid frame of the ground insert.

9. The assembly of claim 8, wherein the rigid frame includes a peripheral channel and a peripheral slot adjacent the outer periphery of the rigid frame, the retained portion of the resilient fastener being received by and retained within the peripheral channel, and the resilient skirt extending through and beyond the side slot.

10. The assembly of claim 9, wherein the rigid frame includes upper and lower spaced rims depending respectively from opposing ends of the wall of the rigid frame, the spaced rims and the wall of the rigid frame forming the peripheral channel for receiving the retained portion of the resilient fastener.

11. The assembly of claim 10, wherein the upper and lower spaced rims of the rigid frame respectively include free ends terminating in opposing spaced lips to define the peripheral slot between the spaced lips, the retained portion of the resilient fastener and the peripheral slot being sized and shaped so that the retained portion of the resilient fastener is captively retained within the peripheral channel by the opposing spaced lips.

12. The assembly of claim 9, wherein the resilient skirt includes parallel spaced ridges extending along a length of the resilient fastener, the parallel spaced ridges extending through and beyond the peripheral slot of the rigid frame.

13. An assembly for selectively grounding at least one contact of a connector to a rear portion of the connector, the rear portion of the connector including a cylindrically shaped inner wall and a plurality of contact back portions at least partially housed by the rear portion and accessible through an opening in the rear portion, said assembly comprising:

(a) an electrically conductive ground insert, including an annular frame having a cylindrically shaped inner wall defining a circumferential perimeter around and spaced from the plurality of contact back portions, the frame defining a circumferentially extending outer channel and a side slot of the frame, the frame including an upper rim accessible through the rear portion opening while the ground insert is within the rear portion, the upper rim including at least one aperture, a circumferentially extending resilient fastener including a retained portion and a resilient skirt contiguous with the retained portion, the retained portion being compressively retained within the channel and entrapped within the channel by the frame, the resilient skirt extending through and beyond the side slot of the frame to form a resilient, circumferentially extending, outer periphery of the ground insert, the resilient outer periphery being adapted and arranged to resiliently engage the inner wall of the connector to thereby fix and electrically connect the ground insert to the rear portion inner wall;

(b) an electrically conductive grounding leg having an elongate body and including a first end and a second end spaced from the first end, the first end including an elongate through aperture, the second end including an apertured spring grip mechanism for resiliently engaging and electrically contacting a contact back portion of the at least one contact; and (c) a threaded fastener for fastening the grounding leg to the ground insert to complete an electrical grounding path between the contact back portion and the rear portion through the grounding leg, the elongate through aperture of the grounding leg sized to receive the fastener, the at least one aperture of the ground insert being sized to receive the threaded fastener such that the threaded fastener threadingly engages the ground insert to thereby fasten the first end of the grounding leg to the ground insert.

14. A connector and grounding assembly, comprising:

a connector, including a connector housing including a connector rear portion, the connector rear portion having an inner wall defining a rear portion interior and an opening into the rear portion interior, an insulating support fixed to and within the connector housing, a plurality of electrical contacts fixed in position by the insulating support, each of the electrical contacts including a contact back portion extending away from the insulating support and into the rear portion interior, the contact back portions being positioned in spaced parallel relation to each other and the connector rear portion inner wall; and an electrical contact grounding assembly including an electrically conductive ground insert having an outer periphery sized and shaped to engage the rear portion inner wall to thereby fasten and electrically connect the ground insert to the rear portion, an electrically conductive grounding leg having first and second spaced ends being adapted and arranged to be respectively fastened to the ground insert and a back portion of one of the electrical contacts to thereby provide an electrical ground path between the one of the electrical contacts and the rear portion of the connector, and a fastener for fastening the first end of the grounding leg to the ground insert while the ground insert is fastened to the connector rear portion.

15. The assembly of claim 14, wherein the ground insert includes an inner periphery being sized and shaped to define a perimeter around and spaced from all of the electrical contact back portions.

16. The assembly of claim 15, wherein the ground insert is continuously formed along the inner and outer peripheries of the ground insert.

17. The assembly of claim 14, wherein the ground insert is split into a pair of substantially identical opposing segments, the opposing segments together forming the inner and outer peripheries of the ground insert while the opposing segments are fixed within the rear portion in abutting relation to each other.

18. A method of selectively grounding at least one electrical contact of an electrical connector, the connector including a plurality of electrical contact back portions at least partially housed within a rear portion of the connector and accessible through an opening in the connector rear portion, comprising:

fixing an electrically conductive ground insert to an inner wall of the rear portion of the connector to electrically connect the ground insert to the rear portion and establish an outer perimeter around and spaced from the plurality of contact back portions; and fastening a first end of an electrically conductive grounding leg to a fastening site of the ground insert using a fastener, and coupling a second end of the grounding leg to the contact back portion to thereby establish an electrical grounding path between the contact back portion and the rear portion through the grounding leg and the ground insert.

19. The method of claim 18, wherein said fastening step includes the step of automatically accommodating variations in a distance between the rear portion inner wall and the contact back portion using an elongate through aperture, formed in the first end of the grounding leg, for receiving the fastener.

20. The method of claim 18, further comprising, in sequence, threading an end of an electrical wire through a spring grip mechanism formed in the second end of the grounding leg;

connecting the end of the electrical wire to the contact back portion; and coupling the spring grip mechanism to the contact back portion.

21. The method of claim 20, wherein said fixing step includes fixing first and second substantially identical halves of the ground insert to the inner wall in abutting relation to each other while electrical wires are connected to at least one of the contact back portions.

* * * * *